United States Patent [19]

Person et al.

[11] Patent Number: 4,613,855

[45] Date of Patent: Sep. 23, 1986

[54] DIRECT CURRENT DOT MATRIX PLASMA DISPLAY HAVING INTEGRATED DRIVERS

[75] Inventors: Herman R. Person; Joseph F. Hesse; Keith T. Raysby, all of Columbus, Nebr.

[73] Assignee: Dale Electronics, Inc., Columbus, Nebr.

[21] Appl. No.: 586,313

[22] Filed: Mar. 5, 1984

[51] Int. Cl.[4] ..... G09G 3/28

[52] U.S. Cl. ..... 340/718; 340/719; 340/771

[58] Field of Search ..... 340/771, 773, 776, 779, 340/718, 719, 774; 358/59; 315/169.4

[56] References Cited

U.S. PATENT DOCUMENTS 4,047,169 9/1977 Holz ..... 340/771
4,292,631 9/1981 Gerard ..... 340/771
4,450,441 5/1984 Person et al. ..... 340/771
4,524,352 6/1985 Greeson, Jr. ..... 340/771

*Primary Examiner*—Gerald L. Brigance
*Attorney, Agent, or Firm*—Zarley, McKee, Thomte, Voorhees & Sease

[57] ABSTRACT

The display device of the present invention includes an upper top plate and a lower substrate, which are joined together to form a plasma filled envelope therebetween. At least one edge of the upper plate extends beyond the envelope, and includes anode drivers attached thereto. At least one edge of the substrate also extends beyond the envelope and includes cathode drivers attached thereto. The cathodes are connected to the cathode drivers and extend within the envelope in parallel relation to one another. The anodes are connected to the anode drivers and extend within the envelope in parallel relation to one another, and in a direction which is perpendicular to the cathodes.

11 Claims, 10 Drawing Figures

14
18
52
50
48
26
12

DIRECT CURRENT DOT MATRIX PLASMA DISPLAY HAVING INTEGRATED DRIVERS

BACKGROUND OF THE INVENTION

This invention relates to dot matrix plasma display devices and particularly to direct current devices having integrated cathode and anode drivers thereon.

Dot matrix plasma displays have been on the marketplace for several years. These devices include a gas filled envelope having anode strips running in one direction and cathode strips running in a direction perpendicular thereto. The intersection points of the anodes and cathodes form various dots or glow points.

The dot matrix plasma displays currently available commercially are of two general types. One type involves the use of direct current. Direct current devices generally have approximately 200 dots across the display which are used to form up to 40 - 5×7 dot matrix characters. Vertically these devices have displayed up to approximately 96 to 100 dots which form approximately 12 lines of 5×7 dot matrix characters.

Direct current devices are recognized in the art as having a deficiency in that they have generally been regarded as being limited to no more than 240 dots across the display. The reason for this is that in direct current plasma displays, each dot is only on for a short period of time. Therefore, when actuating the plasma display, it is necessary to refresh each dot in a short period of time so that the eye does not perceive the blinking or cycling of the dot actuation.

Alternating current devices have also been used. Alternating current plasma displays can be larger than direct current plasma displays because the alternating current devices have an internal memory. That is, each dot does not have to be refreshed with each cycle of actuation. As a result, most of the research activity in new plasma display devices has been in the devices of the alternating current variety.

However, alternating current devices have the disadvantage that they require expensive high voltage, high speed drivers to make them operate satisfactorily.

Therefore, a primary object of the present invention is the provision of an improved direct current dot matrix plasma display.

A further object of the present invention is the provision of a display which will be less costly to manufacture, and which will integrate the plasma display with high voltage drivers.

A further object of the present invention is the provision of a direct current plasma display which reduces the interconnections and connectors presently required between the display and the controlling devices for the display.

A further object of the present invention is the provision of a direct current device which greatly increases the reliability of its operation.

A further object of the present invention is the provision of a display which expands the number of characters permissible across the width of a direct current display over the number of characters presently possible across the width of the present direct current displays.

A further object of the present invention is the provision of a direct current device which significantly reduces the cost of the display.

A further object of the present invention is the provision of a direct current dot matrix plasma display which greatly increases the number of dots per line that can be used in the display.

A further object of the present invention is the provision of a direct current dot matrix display which allows the display to be made with very inexpensive manufacturing techniques.

A further object of the present invention is the provision of a device which is economical to manufacture, durable in use and efficient in operation.

SUMMARY OF THE INVENTION

The present invention utilizes an upper transparent glass plate and a lower substrate which are joined together in spaced apart relation by a sealing material such as solder glass to form an enclosed envelope. On the lower surface of the glass plate, are a plurality of anode strips which extend across the short direction of the rectangular envelope. On the upper surface of the substrate are a plurality of parallel cathode strips which extend transversely to the anode strips and which extend in the direction of the longest dimension of the rectangular envelope. The space between the upper and lower glass plates is from 0.007 inches to 0.010 inches, and is filled with an ionizable gas such as a combination of neon-argon-krypton 85 at 400–700 millimeters of mercury pressure. When a voltage of 150 volts or more is applied between the junctures of the anodes and cathodes, a glow will occur in the space between the two perpendicular strips.

The upper plate includes at least one edge which extends outwardly beyond the envelope, and the substrate includes at least one edge which also extends outwardly beyond the envelope. On the protruding edge of the upper plate glass are attached a plurality of anode drivers. These anode drivers are very large scale integrated circuits that combine logic function and high voltage switches very inexpensively. There are numerous companies which manufacture these devices in large quantities and at low cost. An example of an anode driver which may be used with the present invention is Model No. SN75518FN manufactured by Texas Instruments, Inc., P. O. Box 225621, Dallas, Tex. 75265.

Attached to the protruding surface of the substrate are a plurality of cathode drivers. These cathode drivers are similar to the drivers used for the anodes. An example of a satisfactory cathode driver is Model No. ULN 4823A, manufactured by Sprauge Electric Company, 115 N. E. Cutoff, Worcester, Mass. 01606.

Interconnecting the anode drivers to the anodes are a plurality of connectors. These are printed on the surface of the protruding edge of the upper plate, and they are connected to each anode strip. Similarly, connectors interconnect the cathode drivers with the cathode strips. Both the anode connectors and the cathode connectors may include a resistor that may be printed on the protruding edges of the top plate and substrate.

The preent invention expands the number of characters permissible across the width of a direct current display from that currently used in present direct current displays. Usually present devices limit the width of the display to 40 characters.

The present invention permits a wider display because the scanning is from top to bottom rather than left to right. Also contributing to this result is the added speed of the cathode and anode drivers and the fact that the device can reionize quickly as a result of not using apertures or holes in a dielectric filler between the plates. The device can be expanded to a width of 80 characters or more on a horizontal line, or approximately 518 pixels. As faster drivers become available, the horizontal character length can be increased even further with the present invention.

DETAILED DESCRIPTION OF THE PREFERRED EMBODIMENT

Figure 1:
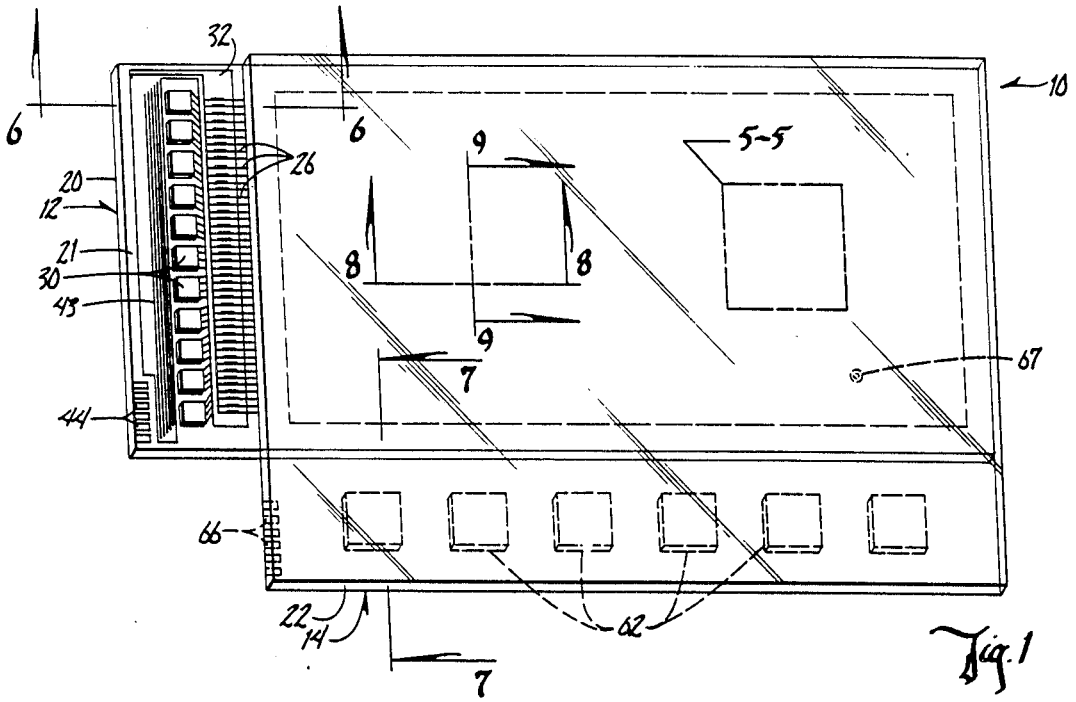
FIG. 1 is a perspective view of the dot matrix plasma display.

The numeral 10 generally designates the direct current dot matrix plasma display unit shown in FIG. 1. Plasma display 10 includes a glass substrate 12 and a glass top plate 14. Plates 12, 14 are rectangular in configuration.

Plates 12, 14 are joined together in spaced apart relation to one another by a solder glass seal 16 which is rectangular in shape and which forms a rectangular shaped sealed envelope 18 therebetween.

Figure 2:
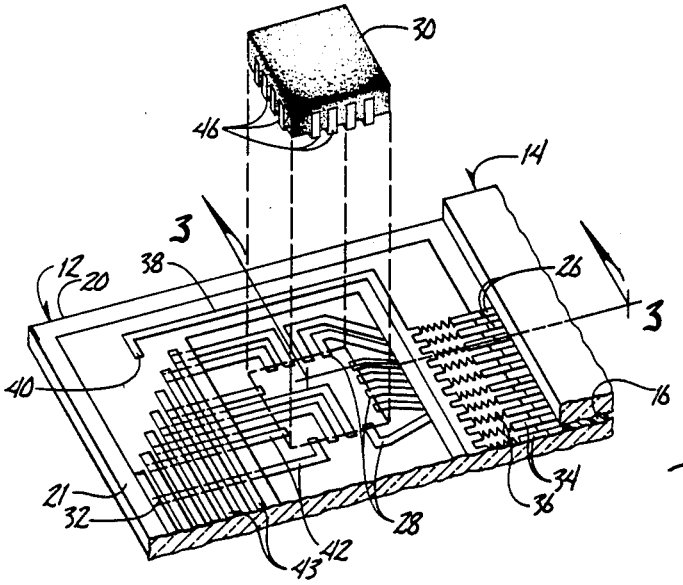
FIG. 2 is an enlarged detailed perspective view of the protruding edge of the substrate, showing the cathode driver detached from the protruding edge of the substrate.
Figure 4:
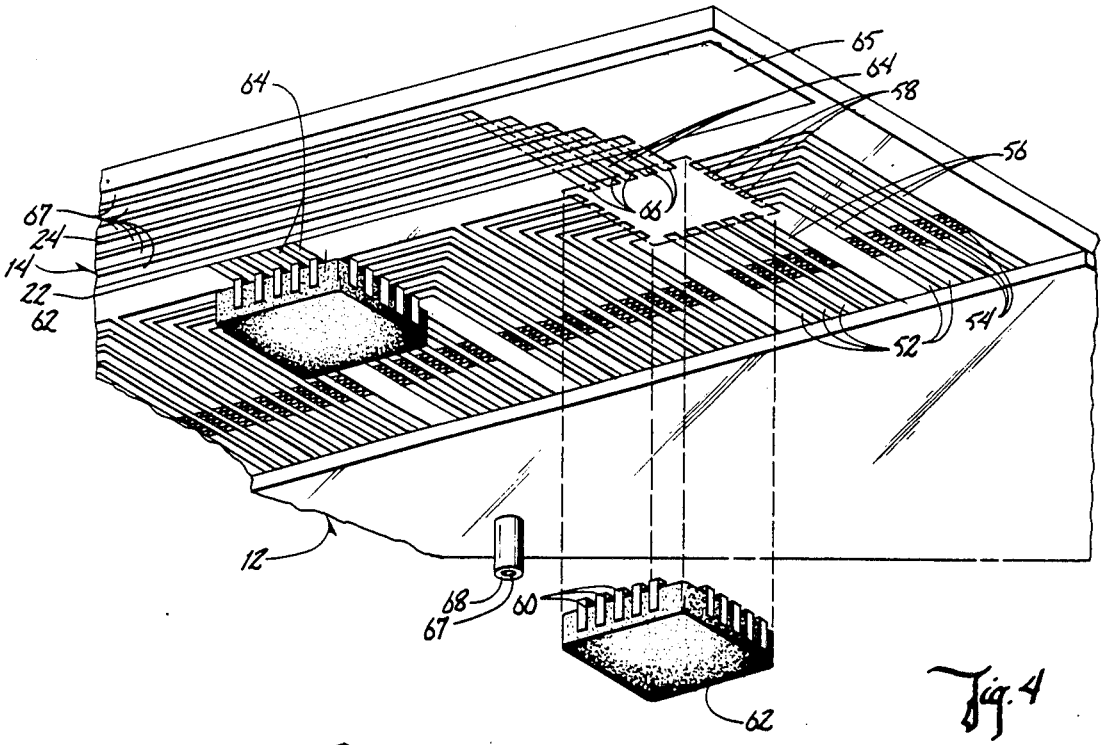
FIG. 4 is an enlarged perspective view of the undersurface of the protruding edge of the top plate, showing the anode driver in exploded perspective.

Bottom plate 12 includes an outward protruding edge 20 having an exposed upwardly presented surface 21 (FIG. 2). Top plate 14 includes an outwardly protruding edge 22 having an exposed downwardly presented surface 24 (FIG. 4).

Figure 3:
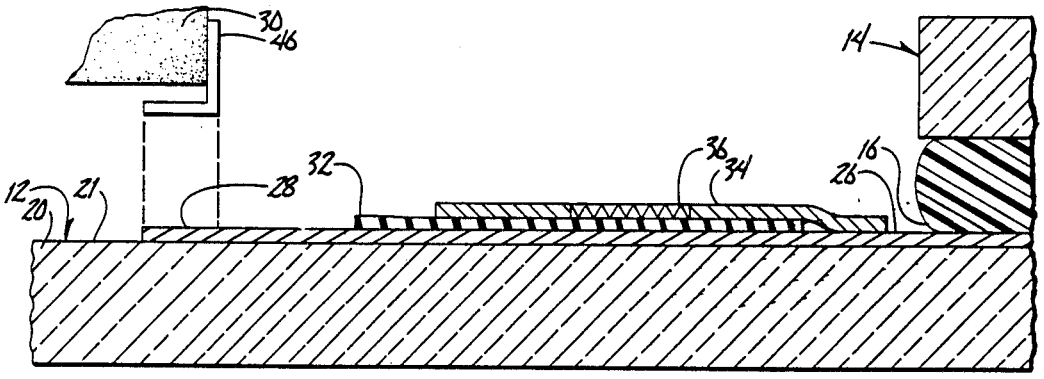
FIG. 3 is an enlarged sectional view taken along line 3—3 of FIG. 2.

Printed on the upper surface of substrate 12 are a plurality of cathode strips 26. Cathode strips 26 extend parallel to one another in a direction along the longest length of the rectangular sealed envelope 18. Cathode strips 26 on the left end (as viewed in FIG. 1) of the envelope, extend through the solder glass seal 16 and protrude outwardly a short distance beyond the outside of the perimeter formed by glass seal 16. As can be seen in FIG. 3, the extreme outer ends of cathode strips 16 each form a pad 28 for receiving a cathode driver chip 30. A dielectric layer 32 is printed over cathode strips 26 as shown in FIGS. 2 and 3.

Printed over dielectric layer 32 are a plurality of conductors 34 which extend beyond the edge of dielectric layer 32 and each of which are in electrical contact with one of cathode strips 26. Each conductor 34 includes a resistor 36 which is printed in series with connector 34. Leading from resistors 36 is a second connector 38 which leads to a pad 40 which can be connected to outside circuitry.

It should be noted that a portion of each cathode strip 26 is exposed between resistor 36 and solder glass 18 so as to provide a means of connecting each cathode strip to a "burn-in" power source for burning the display in without having the burn-in current go through resistors 14. This facilitates the burning in of the device immediately after manufacture, a procedure which is commonly practiced by manufacturers of plasma display devices.

Resistors 36 are printed on the display using conventional thick film techniques, and they are fired so that the resistance value is that which is required to produce the right current in each cathode. Normally this resistance is approximately 50K ohms per resistor. The resistor 36 is positioned at least one-tenth of an inch beyond the solder glass 18 so that a connector or means of connecting to this line can be made for the purposes of burning the display in without having burn-in current go through resistors 36.

As can be seen in FIG. 2, additional connectors 42 extend inwardly and are positioned around the perimeter of the cathode driver chip 30. These additional connectors 42 extend beneath dielectric layer 32 and are connected through holes (not shown) in dielectric layer 32 to a plurality of elongated leads 43. Leads 43 are ultimately connected to a plurality of pads 44 (FIG. 1) on the upper surface of outwardly projecting edge 20. Pads 44 may be connected to outside circuitry.

Cathode driver chips 30 include a plurality of connector pads 46 which may be electrically connected to the various connectors 28, 42 as shown in FIGS. 2 and 3. Chip 30 is a cathode driver which may be purchased from various commercial companies who manufacture these devices in large quantities. An example of such a driver is Model No. ULN 4823A, manufactured by Sprauge Electric Company, located at 115 N. E. Cutoff, Worcester, Mass. 01606.

Figure 5:
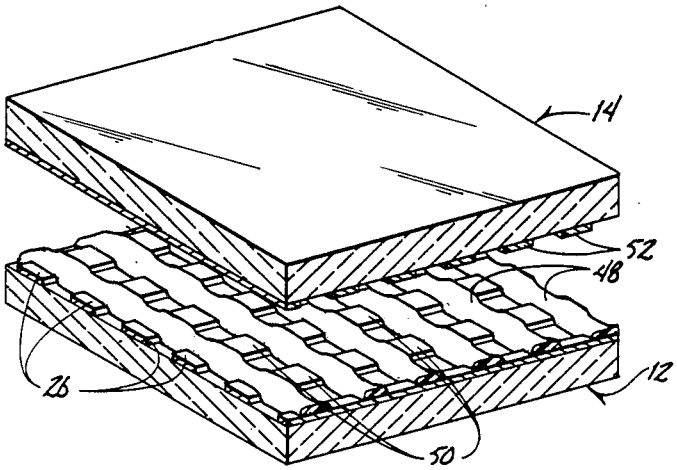
FIG. 5 is a perspective sectional view cut out along 5—5 of FIG. 1.
Figure 6:
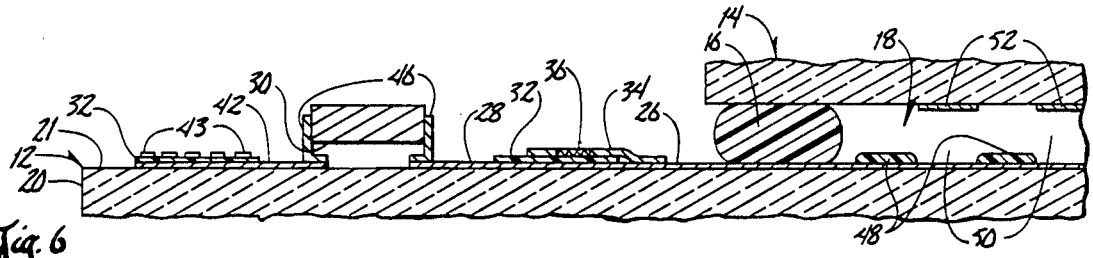
FIGS. 6 and 7 are sectional views taken along lines 6—6 and 7—7 of FIG. 1.
Figure 7:
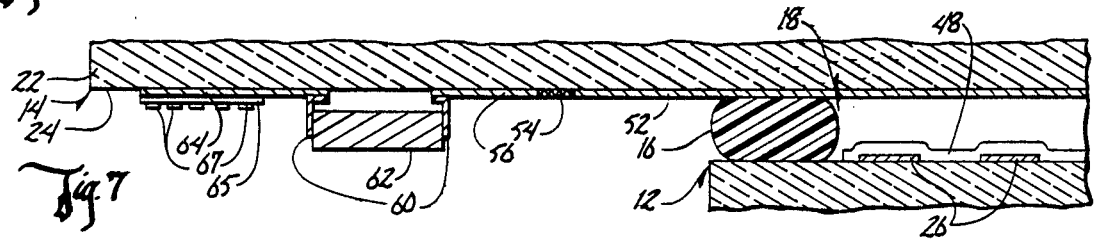

Referring to FIG. 5, a plurality of dielectric strips 48 are printed over cathode strips 26 and extend parallel to one another in a direction perpendicular to the cathode strips 26. The portions of the cathode strips 26 which are left exposed form a plurality of dots 50 which form the dots of the matrix.

As can also be seen in FIG. 5, the upper plate 14 (which is preferably transparent glass), has a plurality of transparent tin oxide anode strips 52 printed thereon. Strips 52 are parallel to one another and extend in a direction perpendicular to the direction of cathode strips 26. The anode strips 52 are in registered alignment above dots 50. Envelope 18 is filled with an ionizable gas, and therefore actuation of any single anode strips 52 and any single cathode strips 26 causes ionization of the gas adjacent the dot 50 which forms the juncture between the two actuated anode and cathode strips. The ionization of this gas causes a glow to appear, which can be viewed through the transparent glass plate 14.

Figures 8, 9:
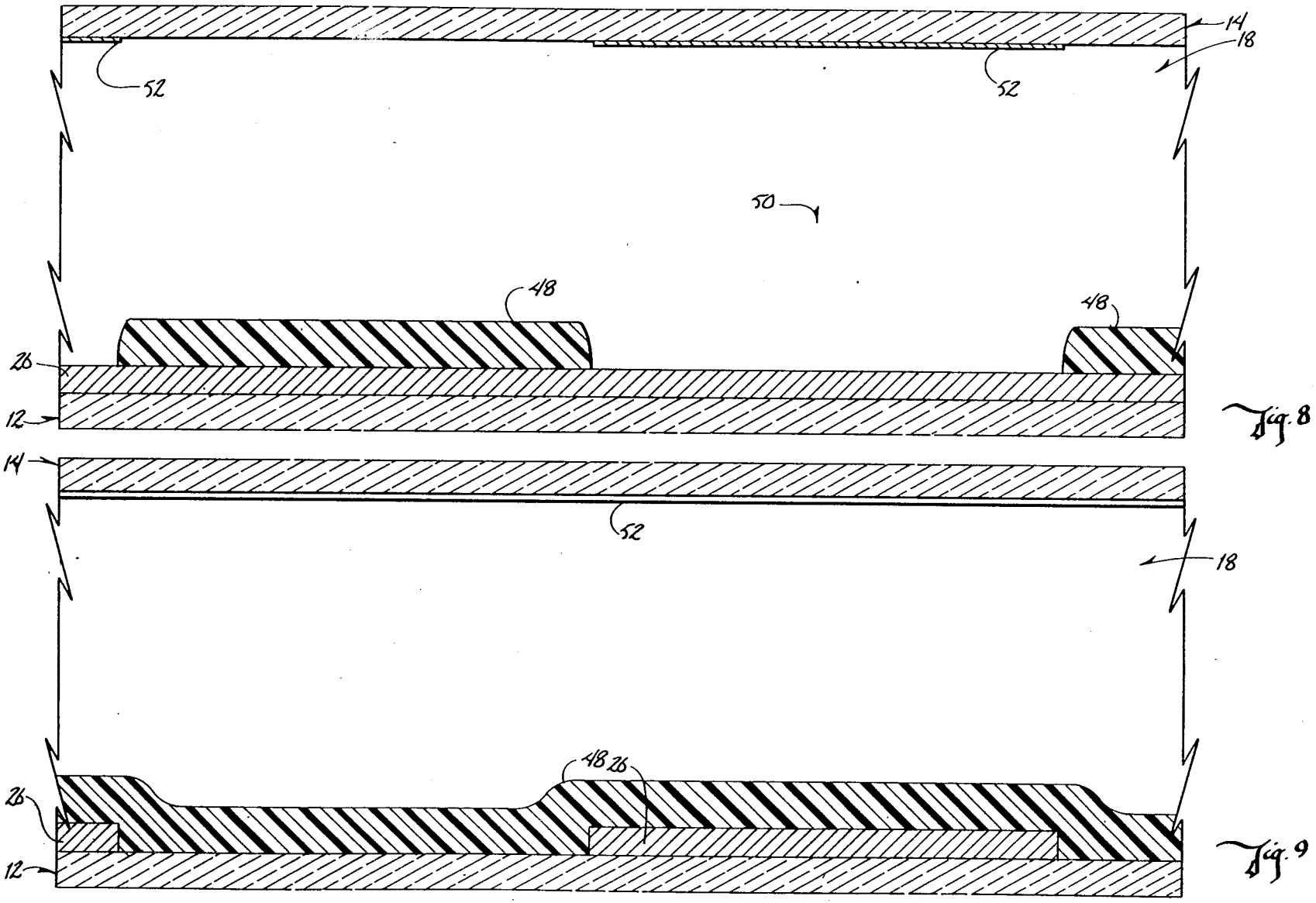
FIGS. 8 and 9 are enlarged sectional views taken along lines 8—8 and 9—9, respectively, of FIG. 1.

Referring to FIG. 8, the preferred thickness of cathode strips 26 is $\frac{1}{2}$ to $\frac{3}{4}$ mils; the preferred thickness for dielectric strips 48 is approximately 1 mil; and the preferred thickness for anode strips 52 is approximately 1/10 mil. The space between upper plate 14 and substrate 12 is preferably between 0.007 inches to 0.010 inches and is filled with a neon-argon-krypton 85 gas which is kept at a pressure of from 400–700 millimeters of mercury pressure. When a voltage of 150 volts or more is applied between the anode and cathode strips, a glow will occur at the dot 50 which forms the juncture between the two actuated strips.

FIG. 4 shows the downwardly presented surface 24 of the outwardly protruding edge 22 of top plate 14. As can be seen in FIG. 4, anode strips 52 protrude outwardly beyond the edge of substrate 12 and are connected to a plurality of printed resistors 54. Extending from resistors 54 are a plurality of connectors 56 which terminate in a plurality of pads 58 positioned for engagement with complementary pads 60 on an anode driver chip 62. A plurality of outside connectors 64 include a plurality of outside pads 66, also positioned for connection to the pads 60 of chip 62. Outside connectors 64 extend beneath a printed dielectric layer 65. Each connector 64 is connected through a hole (not shown) in dielectric layer 65 to one of a plurality of additional connectors 67 which are printed on the exposed surface of dielectric layer 65 and which are connected to a plurality of outside pads 66 (FIG. 1). Outside pads 66 may be connected to outside circuitry. It should be noted that resistors 54 are spaced from the outer edge of substrate 12 so that it is possible during the burning-in process to provide electrical connection between resistors 54 and the edge of substrate 12 for burning in the device.

The method of fabrication is as follows: Glass substrate 12 is made up of one-eighth inch float glass, cut to an appropriate size, depending upon the particular style of display being constructed. Glass substrate 12 is then drilled with a water cooled ultrasonic drill for the purpose of providing an evacuation/fill orifice 66 therein.

A thick film printing process is then used to provide the various insulating and conductive film inks on the substrate. First, a platinum silver thick film composition manufactured by duPont under the product designation 7712, is printed onto the glass substrate, to define the pads 44. The printed pads are permitted to dry in the air and then are fired at approximately 585° C. in a kiln.

Next, a conductor of nickel film manufactured by duPont under the product designation 9535, is printed onto the substrate 12 to define the cathode bars or strips 26. The cathode bars are in parallel lines, and preferably have dimensions of 0.010 inches to 0.020 inches in width, and from one inch to eight inches in length. They are approximately 20 to 50 microns in thickness.

The cathode bars 26 may run either horizontally or vertically, depending upon how it is desired to drive the display. However, it is preferred that the cathode bars extend the longest dimension of the device, because they are made of highly conductive material, whereas, the anodes, being made of a transparent conductor, exhibit a much greater resistance, and consequently a greater voltage drop over a given linear distance.

After the cathode bars have been permitted to dry and are fired in a 585° C. kiln, the dielectric layer 32 and the dielectric strips 48 are printed thereon. The material for the dielectric layer is preferably a thick film dielectric compositon manufactured by duPont under the product designation 9541. It is printed onto the substrate to define the individual cathode dots 50 running along the cathode bars or strips 26. The exposed dots 50 may have dimensions of from 0.010 to 0.020 inches. The other dielectric compositions which may be used for insulating material are Electro Science 4023B and 4028B.

The dots may be of several arrangements:

(1) a solid array of dots commonly referred to as an XY array may be provided with dimensions suitable to the geometry and design of the display;

(2) dots grouped together to form characters may also be provided, and these characters usually consist of an array of dots, five dots by seven dots. An additional row of dots may provide an underbar or cursor if desired. Other suitable arrangements include an array of seven dots by nine dots or any other array desired by the end user. The dielectric layer in addition to defining the cathode dots, provides an insulating layer which covers those portions of the cathode bar not wanted to be lighted when the display is operating.

The next step in the manufacture of the device is to print the sealing paste on the substrate 12 for purposes of forming a hermetic seal for the rectangular envelope 18. This material forms a raised wall enclosing th dots 50, and this raised wall has a thickness of from 0.007 to 0.010 inches. The printed material may be preglazed in either a box oven or a kiln, with a peak temperature of 500° C. for approximately ten minutes. After the glazing process, the substrate is ready for the sealing operation. While waiting for the sealing operation, the substrate is stored in a dry nitrogen atmosphere during the preparation of cover plate 14.

The glass cover plage 14 is made up of one-eighth inch float glass which has a transparent tin oxide layer deposited on one side. The cover glass is available from Pittsburgh Plate Glass Company under the trade designation "NESA" with resistivities down to 80 ohms per square, with a tolerance of plus or minus 50%. Other sources of tin oxide coated glass include Photon Power, Inc. which produces glass having resistivities of 8–12 ohms per square. It is of importance that the tin oxide coating be as close as possible to 100% free of scratches for obtaining a completely workable display. One should be very careful to avoid fingerprinting the glass, inasmuch as the fingerprints can interfere with the acid etching which occurs later.

The tin oxide coated layers are then carefully printed with an etch resistant material which is printed in a pattern defining the tin oxide anodes to be formed in the ultimate product. Several screen printable etch resistant compositions are available commercially and are well known in the art. The etch resistant printing is dried at 100° C. for approximately ten minutes, and is then ready for the acid etching. Acid etching is accomplished by immersing the coating in a warm acid bath. First, a solution of zinc metal powder and deionized water is printed onto the coated side of the plate. The glass cover is then immersed in a heated mixture of one part deionized water to one part of 50% hydrochloric acid. For best results, the temperature of this acid bath should be between 39°–55° C. The glass covers should remain in the acid bath for no longer than 15–20 seconds, inasmuch as longer periods of time result in undercutting of the etch resist, an undesirable result. After the recommended time period, the glass cover is removed from the acid bath and immersed in a rinse of plain deionized water. After being permitted to dry, the glass covers will be fully and properly etched with only the tin oxide coating for anodes 52 remaining.

The etch resistant coating is then removed by means of a 6% caustic soda solution slightly warmed. After this, the glass is immersed in an alcohol deionized water bath, and gently wiped dry. The etched pattern will be a series of straight parallel transparent conductors which form anodes 52.

Connectors 56, pads 58, and resistors 54 are then printed on the glass to form the conductor patterns shown in FIG. 4. Each connector 56 has a resistor 54 printed in series as shown in FIG. 4. This resistor material is printed on the display using conventional thick film techniques, and is fired so that the resistance value is that which is required to produce the right current in each anode strip. Normally this required resistance is approximately 50K ohm per resistor.

The glass cover next receives a print of duPont 9535 nickel conductive composition for the purpose of forming keep-alive covers if they are warranted.

The glass cover 14 is then ready to be joined to the glass substrate 12 for purposes of forming a hermetic seal. Cover 14 is positioned over substrate 12 with anodes 52 being perpendicular to cathodes 26 and being in careful alignment with the columns of dots 50.

Once the glass cover is aligned properly over substrate 12, clamps are applied to hold it in place. Then a fill tubulation 68 (FIG. 4) is positioned over the evacuation hole 66. The fill tubulation is generally manufactured from glass and has a thermal coefficient which matches with the glass substrate 12.

The assembly is then set into an oven and heated to 480°–500° C. which causes the sealing glass 16 to be reheated and remelted so as to flow together and form a hermetic seal around envelope 18. The sealing glass for the fill tubulation, also melts and forms a hermetic seal at the fill tubulation substrate junction. After 5 to 30 minutes, the hermetic seal is completed, and the unit is slowly cooled down to room temperature.

A small glass capsule containing mercury is then dropped down the tubulation so as to provide means to introduce mercury to the display later. The purpose of the mercury is to retard the cathode sputtering which occurs in the plasma when the gas discharge is initiated. An alternative method to the mercury capsule is the use of a mercury giver ring or pill which is commercially available.

The display is then attached to a high vacuum pump for purposes of pumping out all the air. The envelope is then filled with a Penning mixture of 99.5% neon gas, 0.5% argon gas, and a trace of krypton-85 radioactive gas. Backfill pressures should typically be 400–700 millimeters of mercury pressure. The unit is then sealed off by heating the filled tubulation at a point about two to three inches from the lower surface of the substrate. This softens the glass and allows the fill tubulation to collapse. When fully collapsed, the unit may be pulled away, causing the softened portion of the tubulation to separate. The Penning mixture is then sealed inside the display.

The mercury capsule is then burst by use of an infrared gun and the unit is placed in a 300°–350° C. oven for purposes of moving the mercury into the display. The remainder of the fill tubulation is then cut off just above the point where it is attached to the substrate, which is approximately one-half inch from the substrate.

FIG. 2 shows the method used to connect the driving circuit to the cathode lines. Pad 28 is connected to the cathode lines 26. Dielectric material 32 is printed over the cathode lines 26, and conductors 34 having resistors 36 therein, are printed over the dielectric layer 32. One end of each conductor 34 protrudes beyond the edge of dielectric layer 32 and extends downwardly into electrical contact with cathodes 26. Conductors 34 and resistors 36 form the pull-up resistor network if required. The pull-up resistor network permits the application of outside circuitry to pull up the various cathodes to a desired voltage, which, when added to the voltage signals sent from the cathode drivers 30, will cause the cathodes to be actuated and ionization glow to occur.

After the display has been constructed as described above, and the display is burned in and tested to be sure that it works properly, anode drivers 62 and cathode drivers 30 are soldered to the contacts or conductor materials as indicated in FIGS. 2 and 4. This is accomplished by using a standard operation known as vapor phase soldering technique.

The cathode drivers, because of their connection to the cathode strips, permit the driving of the cathode strips in response to predetermined input signals. Similarly, the anode drivers drive the anode strips.

Figure 10:
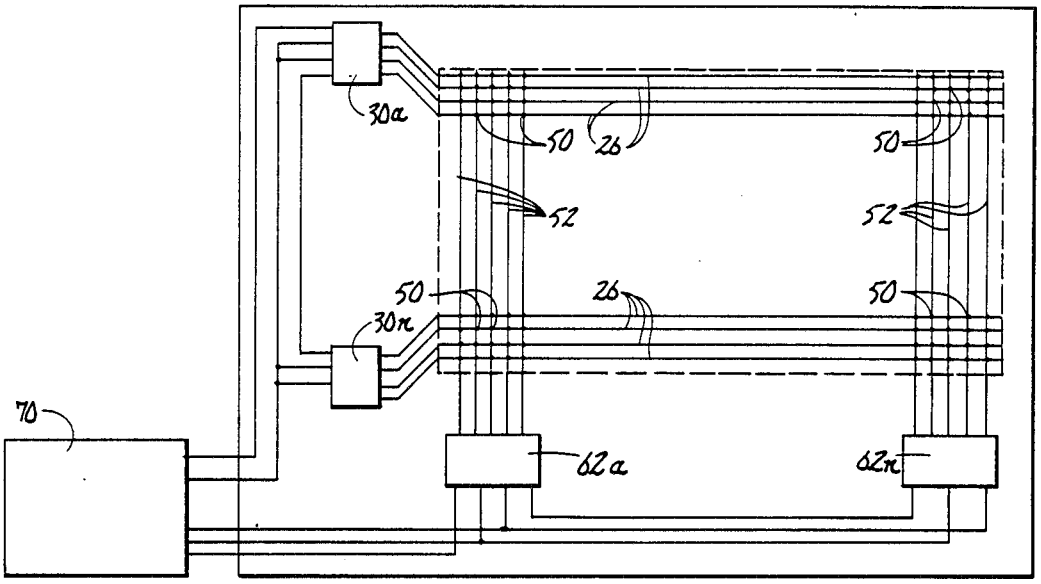
FIG. 10 is a schematic drawing showing the way the anode and cathode drivers are interconnected.

FIG. 10 illustrates schematically the manner in which the device operates. External circuitry is designated in FIG. 10 by the box 70. This circuitry distributes signals to cathode drivers 30A–30N, and anode drivers 62A–62N. In the first step of the cycle, a single cathode strip 26 is actuated and a plurality of anode strips 52 are simultaneously actuated. Then all the cathode and anode strips are shut off. Next, a second signal causes a second cathode strip to be actuated, and a second group of anode strips 62A–62N to be actuated. This process continues, actuating one cathode strip and a plurality of anode strips in response to each signal until all of the cathode strips have been actuated. The device then recycles beginning with the first cathode strips and repeating the cycle. These cycles are repeated at a speed which is imperceptive to the human eye, so that the dot matrix appears to be continuously actuated.

The present invention uses elements of the dot plasma display in a high voltage direct current device. The drivers for both the anode and cathode strips are integrated with the plasma display itself, and combine logic, function and high voltage switches very inexpensively. The present invention greatly reduces the interconnections and connectors between the display and the controllers, as was the case in prior devices. Furthermore, because the drivers are integral with the device, there is considerable increase in the reliability of the plasma display. The cost of manufacture is substantially reduced.

Another advantage gained from the present invention is that the number of dots per square inch can be increased. This is partly due to the use of dielectric strips 48 in the place of a solid dielectric layer having holes therein as was used in prior devices. The display can be made with very inexpensive manufacturing techniques, and this further contributes to the economy of the device.

Thus, it can be seen that the present invention accomplishes at least all of its stated objectives.

What is claimed is:

1. A dot matrix plasma display comprising:

a rectangular substrate having opposite end edges, opposite side edges, and an upwardly presented surface, a rectangular transparent top plate having opposite end edges, opposite side edges, and a downwardly presented surface;

sealing means holding said substrate and said top plate in parallel spaced apart relation to one another, said sealing means forming a continuous seal between said substrate and said top plate so as to define a sealed envelope therebetween;

one of said edges of said substrate extending outwardly beyond said sealing means so as to form a first upwardly facing mounting surface, outside said envelope;

one of said edges of said top plate extending outwardly beyond said sealing means so as to form a second downwardly facing mounting surface outside said envelope;

a plurality of elongated anode strips mounted on said top plate and extending within said envelope in a first direction parallel and spaded apart from one another;

a plurality of elongated cathode strips mounted to said substrate and extending within said envelope in a second direction parallel and spaced apart from one another, said second direction being transverse to said first direction;

cathode driving means for driving said cathode strips, said cathode driving means being attached to and mounted to said fist mounting surface of said substrate and having a plurality of cathode driver pads;

said cathode strips each having an outer end extending from within said envelope to outside said envelope and being connected to at least one of said cathode driver pads;

a plurality of cathode connecting means on said first mounting surface of said substrate, said cathode connecting means each having a first end connected to another of said cathode driver pads and having a second end adapted for connection to outside circuitry;

anode driving means for driving said anode strips, said anode driving means being attached to and mounted to said second mounting surface of said top plate and having a plurality of anode driver pads;

said anode strips each extending from within said envelope to outside said envelope and being connected to one of said anode driver pads;

a plurality of anode connecting means on said second mounting surface of said top plate, said anode connecting means each having a first end connected to another of said anode driver pads and having a second end adapted for connection to outside circuitry.

2. A device according to claim 1 wherein a plurality of pull-up network means are each connected to one of said cathode strips, each of said pull-up network means comprising a resistor and a conductor mounted on said first mounting surface, said conductor being adapted for connection to outside circuitry.

3. A device according to claim 2 wherein a dielectric layer is printed on said first mounting surface over said cathode strips, said pull-up network means being printed over said dielectric layer.

4. A device according to claim 3 wherein said pull-up network means are each connected to said one cathode strip at a connection point spaced outwardly from said sealing means so as to create an exposed portion of said one cathode strip between said sealing means and said connection point, said dielecttic layer also leaving said exposed portions of said cathode strips uncovered.

5. A device according to claim 3 and further comprising a plurality of anode resistors printed on said second mounting surface outside said envelope, each of said anode resistors being connected in series between one of said anode strips and one of said anode driving means.

6. A device according to claim 1 wherein said cathode driving means and said anode driving means comprise integrated circuit chips which are attached to and fully supported by said first and second supporting surfaces respectively.

7. A device according to claim 1 and further comprising a plurality of anode resistors printed on said second mounting surface outside said envelope, each of said anode resistors being connected in series between one of said anode strips and one of said anode driving means.

8. A device according to claim 1 wherein said cathode connecting means are printed on said substrate and said anode connecting means are printed on said top plate.

9. A dot matrix plasma display comprising:

a rectangular substrate having opposite end edges, opposite side edges, and an upwardly presented surface, a rectangular transparent top plate having opposite end edges, opposite side edges, and a downwardly presented surface;

sealing means holding said substrate and said top plate in parallel spaced apart relation to one another, said sealing means forming a continuous seal between said substrate and said top plate so as to define a sealed envelope therebetween;

one of said edges of said substrate extending outwardly beyond said sealing means so as to form a first upwardly facing mounting surface, outside said envelope;

one of said edges of said top plate extending outwardly beyond said sealing means so as to form a second downwardly facing mounting surface outside said envelope;

a plurality of elongated anode strips mounted on said top plate and extending within said envelope in a first direction parallel and spaced apart from one another;

a plurality of elongated cathode strips mounted on said substrate and extending within said envelope in a second direction parallel and spaced apart from one another, said second direction being transverse to said first direction;

cathode driving means for driving said cathode strips, said cathode driving means being attached to and mounted to said first mounting surface of said substrate and having a plurality of cathode driver pads;

said cathode strips each having an outer end extending from within said envelope to outside said envelope and being connected to at least one of said cathode driver pads;

anode driving means for driving said anode strips, said anode driving means being attached to and mounted to said second mounting surface of said top plate and having a plurality of anode driver pads;

said anode strips each extending from within said envelope to outside said envelope and being connected to one of said anode driver pads;

an ionizable gas within said envelope capable of producing ion glow in response to opposite charges being placed on said cathode strips and said anode strips;

plurality of dielectric strips printed on said upwardly presented surface of said substrate, said dielectric strips being spaced apart and parallel to one another and extending transversely to and over said cathode strips within said envelope, said dielectric strips being spaced below said anode strips within said envelope so as to create an open space within said envelope and between said dielectric strips and said anode strips, said open space being free from barriers.

10. A device according to claim 9 wherein said sealing means holds said downwardly presented surface of said top plate and said upwardly presented surface of said substrate approximately 0.007 to 0.010 inches apart to form said envelope.

11. A device according to claim 10 wherein said envelope is filled with an ionizable gas at 400 to 700 millimeters of mercury pressure.

* * * * *